US008591246B2

(12) United States Patent
Banko et al.

(10) Patent No.: US 8,591,246 B2
(45) Date of Patent: Nov. 26, 2013

(54) DATA PORT CONNECTOR AND HOUSING

(75) Inventors: Joshua Banko, Palo Alto, CA (US); Brett William Degner, Menlo Park, CA (US); John Raff, Menlo Park, CA (US); Chris Ligtenberg, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/276,327

(22) Filed: Oct. 19, 2011

(65) Prior Publication Data

US 2012/0034808 A1 Feb. 9, 2012

Related U.S. Application Data

(62) Division of application No. 12/242,712, filed on Sep. 30, 2008.

(60) Provisional application No. 61/019,280, filed on Jan. 6, 2008.

(51) Int. Cl.
*H01R 13/627* (2006.01)

(52) U.S. Cl.
USPC ..... 439/350

(58) Field of Classification Search
USPC ..... 439/382, 384, 680, 350, 349, 357–358, 439/445, 447, 852, 856–857, 633, 677
See application file for complete search history.

(56) References Cited

U.S. PATENT DOCUMENTS

| | | | | |
|---|---|---|---|---|
| 2,944,241 | A * | 7/1960 | Londell, Jr. | 439/357 |
| 3,268,851 | A * | 8/1966 | Mancini | 439/857 |
| 3,976,347 | A * | 8/1976 | Cooke et al. | 439/475 |
| 6,109,967 | A * | 8/2000 | Chiou | 439/607.52 |
| 6,733,319 | B1 * | 5/2004 | Jørgensen | 439/329 |
| 7,252,549 | B2 | 8/2007 | Nishio et al. | |
| 7,513,806 | B2 * | 4/2009 | Noda et al. | 439/852 |

OTHER PUBLICATIONS

Non-Final Office Action mailed on Sep. 4, 2009 for U.S. Appl. No. 12/242,712, 7 pages.
Non-Final Office Action mailed on Sep. 15, 2010 for U.S. Appl. No. 12/242,712, 8 pages.
Final Office Action mailed on Dec. 29, 2010 for U.S. Appl. No. 12/242,712, 8 pages.

* cited by examiner

*Primary Examiner* — Felix O Figueroa
(74) *Attorney, Agent, or Firm* — Kilpatrick Townsend & Stockton LLP

(57) ABSTRACT

Connector receptacles having a reduced height or z-dimension that are capable of accepting standard sized connector inserts. One example provides a connector having a reduction in the amount of height consumed by the deflection of a number of fingers. Specifically, the amount of deflection is reduced by eliminating one or more of these fingers on one or both sides of the connector receptacle. Instead of fingers, bumps may be used. These bumps fit into the connector insert cutouts or slots when the connector insert is fully inserted in the connector receptacle. Another example uses a rail, which may be referred to as speed rail. This speed rail can be formed along the seam of connector receptacle. The speed rail can run either a portion or the entire depth of the connector receptacle.

19 Claims, 9 Drawing Sheets

FRONT VIEW

BOTTOM VIEW

SIDE VIEW

TOP VIEW

A

SIDE VIEW ALONG "A"
AT START OF INSERTION

RESISTANCE BEGINS

INSERT RIDES UP ON SPEED
BUMP AND FINGER DELECTS

INSERT LATCHED

FRONT VIEW

BOTTOM VIEW

SIDE VIEW

B

TOP VIEW

SIDE VIEW ALONG "B"
AT START OF INSERTION

RESISTANCE INCREASES

INSERT RIDES UP ON SPEED
RAIL AND FINGER DEFLECTS

INSERT LATCHED

FRONT VIEW

SIDE VIEW

BOTTOM VIEW

TOP VIEW

SIDE VIEW ALONG "C"
AT START OF INSERTION

RESISTANCE INCREASES

INSERT RIDES PUSHES SPEED
RAIL AND SPEED BUMP APART
AND RECEPTACLE OPENS

INSERT LATCHED

FRONT VIEW

SIDE VIEW

DATA PORT CONNECTOR AND HOUSING

CROSS-REFERENCES TO RELATED APPLICATIONS

This application is a divisional of U.S. application Ser. No. 12/242,712, filed Sep. 30, 2008, which claims the benefit of U.S. provisional application No. 61/019,280, filed on Jan. 6, 2008, all of which are incorporated by reference.

BACKGROUND

Mobile devices such as laptop and notebook computers, media players, and others have become ubiquitous the last few years and their popularity shows no signs of abating. To meet demand, designers have developed a wide range of devices having a constellation of form factors. One trend that has emerged is the desire for narrower, slimmer devices. Part of the motivation for this is practicality; a slimmer device is lighter and more portable. Part of the motivation is stylistic, thin devices, such a laptops, are simply attractive.

But there are limits to how slim a mobile device can get. One limiting factor has been the size of connectors used to interface these mobile devices to external devices. In particular, connector receptacles are typically located on the mobile devices. Cables having connector inserts on one or both ends are used to convey electronic or optical signals between the mobile device and an external device.

These connector receptacles typically have a certain height. Height may also be referred to as the z-dimension. Height consumed by the connector receptacle limits how slim the mobile device can get. Even if slimness is not the goal, this height is undesirable as it also consumes space inside the mobile device that could be used for circuitry or other components. Unfortunately, these receptacles cannot be made arbitrarily narrower. This is because they are often designed to receive a connector insert having a specified size.

Thus what is needed are circuits, methods, and apparatus that provide connector receptacles having a reduced height but that are capable of accepting standard sized connector inserts.

SUMMARY

Accordingly, embodiments of the present invention provide connector receptacles having a reduced height or z-dimension but are capable of accepting standard sized connector inserts.

An exemplary embodiment of the present invention provides a connector receptacle having a reduction in the amount of height consumed by the deflection of a number of fingers. Specifically, as a connector insert is inserted in the connector receptacle, the fingers deflect or open. As they deflect, the size of connector receptacle increases, thereby effectively increasing the height of the connector. When the connector insert is fully inserted into the connector receptacle, the fingers close by fitting into a cutout or slot on the connector insert. In a specific embodiment of the present invention, the total amount of deflection is reduced by eliminating one or more of these fingers.

Another exemplary embodiment of the present invention eliminates the fingers on one side of the connector receptacle. Instead of fingers, bumps, which may be referred to as speed bumps, are used. These bumps fit into the connector insert cutouts or slots when the connector insert is fully inserted in the connector receptacle.

Another exemplary embodiment of the present invention also eliminates the fingers on one side of the connector receptacle. Instead of fingers, a rail, which may be referred to as speed rail, is used. This speed rail can be formed along the seam of connector receptacle. The speed rail can run either a portion or the entire depth of the connector receptacle.

Another exemplary embodiment of the present invention eliminates the fingers on both side of the connector receptacle. Instead, a combination of speed bumps or speed rails can be used. In a specific embodiment of the present invention, the housing of the connector receptacle is split along each of two sides. This allows the connector receptacle to widen or deform as a connector insert is inserted.

Another exemplary embodiment of the present invention provides a narrower connector receptacle having a tactile response close to that of a standard connector receptacle. That is, as a user inserts a connector insert, the initial friction and force needed to insert the connector insert is similar to that of a conventional receptacle. As the connector insert is fully inserted, the user experiences an expected tactile and possibly aural response letting her know that a connection has been made. Also, there is sufficient holding strength to maintain a connection during device use to provide a force to be overcome by the user when the connector insert is extracted.

Various embodiments of the present invention may incorporate one or more of these and the other features described herein. A better understanding of the nature and advantages of the present invention may be gained by reference to the following detailed description and the accompanying drawings.

DESCRIPTION OF EXEMPLARY EMBODIMENTS

Figure 1:
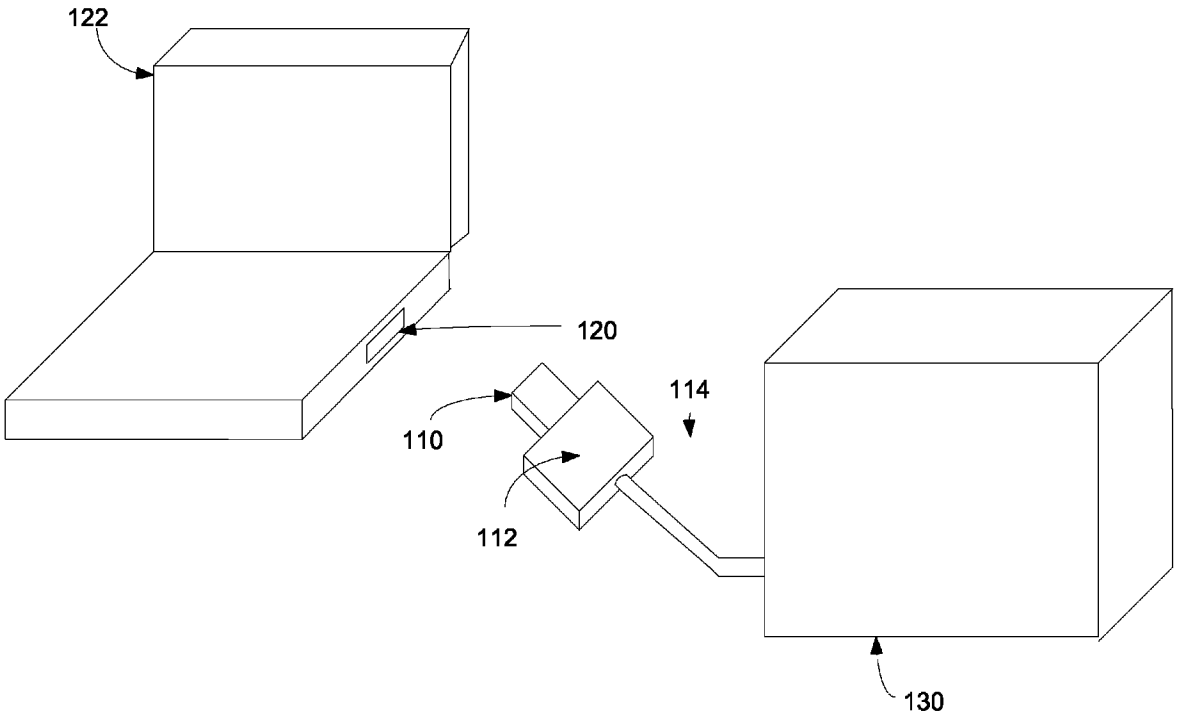
FIG. 1 illustrates a data transfer system that may be improved by the incorporation of an embodiment of the present invention.

FIG. 1 illustrates a data transfer system that may be improved by the incorporation of an embodiment of the present invention. The system includes a laptop 122 that may receive and transmit data from a USB device 130. A data connection including cable 114, connector insert 110, and connector receptacle 120 facilitates data transfers between the laptop 122 and USB device 130. This figure, as with the other included figures is shown for illustrative purposes only and does not limit on any possible embodiments of the present invention or the claims.

The connector insert 110 fits in the connector receptacle 120 forming electrical connections such that data can be transferred between the laptop 122 and the USB device 130 over the cable 114. The connector insert 110 includes a connector insert housing 112 that may be held by a user when the connector insert 110 is inserted into the connector receptacle 120.

In this specific example, a laptop 122 is shown. In other embodiments of the present invention, the connector receptacle 120 may be located on other mobile or non-mobile devices such as media players, desktop computers, notebook computers, or other electronic devices. The USB device 130 may be any appropriate device such as a monitor, disk drive, printer, or other electronic device.

While embodiments of the present invention are particularly suited to USB connector receptacles, other embodiments of the present invention may be used to improve other standard or proprietary connector receptacles.

Standard USB receptacles include a connector board or tongue. Contacts or connector pins are located on this tongue. These pins mate with pins on a connector insert forming electrical connections between the connector insert and the connector receptacle. An illustration of such a connector receptacle is shown in the following figure.

Figure 2:
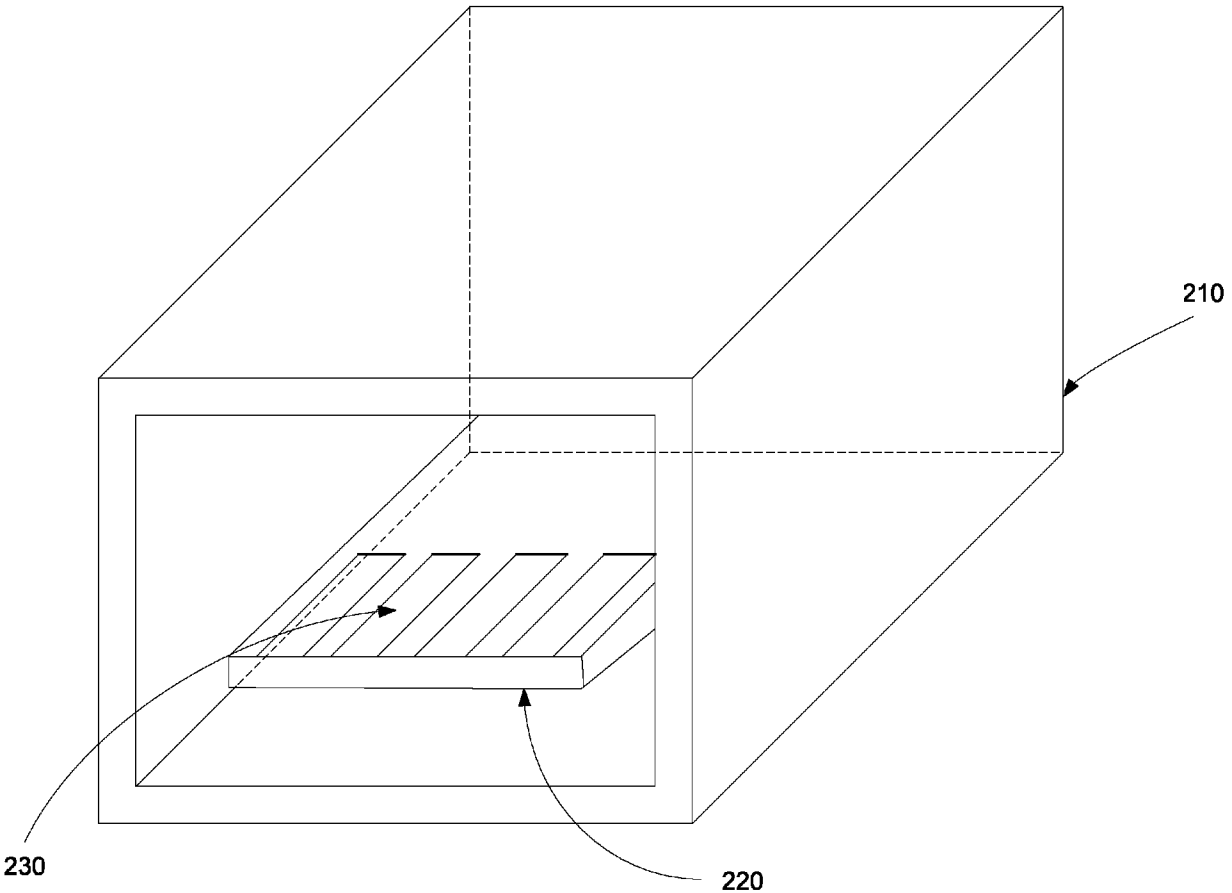
FIG. 2 illustrates a perspective view of a connector receptacle that may be improved by an embodiment of the present invention.

FIG. 2 illustrates a perspective view of a connector receptacle that may be improved by an embodiment of the present invention. The connector receptacle includes a connector receptacle shell 210. Inside the connector receptacle shell 210 is a connector board or tongue 220. Connector pins 230 are located on the tongue 220. For USB, these pins include four pins total, specifically, a power, a ground, and two data pins.

Conventional USB receptacles include two cutouts or fingers (not shown) on the top of the receptacle shell 210 and two cutouts or fingers (not shown) on the bottom of the connector receptacle shell 210. As a connector insert is inserted into the front of the connector receptacle shell 210, these fingers deflect out of the way. This deflection must be accounted for in the design of the device circuitry or other components and housing surrounding the connector receptacle shell 210. In various embodiments of the present invention, it is desirable to reduce this total deflection thereby reducing the effective height of the connector receptacle. In other embodiments of the present invention, it is desirable to shift the total deflection, such that the deflection occurs on only the top or bottom of the connector receptacle shell, instead of occurring on both sides of the receptacle shell. An embodiment of the present invention that achieves this is shown in the following figure.

FIGS. 3A-3D illustrate side, front, top, and bottom views of a connector receptacle shell according to an embodiment of the present invention. In this example, one or more fingers 320 are placed on the bottom of the connector receptacle shell 310. One or more bumps, referred to here as speed bumps 330, replace fingers on the top of the connector receptacle shell 310. Accordingly, there is no deflection on the top of the connector shell. Rather, all of the finger deflection occurs on the bottom of the connector receptacle shell 310. By adjusting the height of the speed bump 330, the total deflection and of the finger 320 may be made less than the total deflection of a standard USB connector receptacle. This in turn reduces the effective height of the connector receptacle shell 310.

Figure 3B:
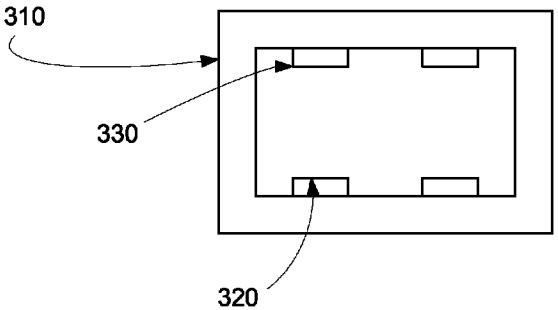
FIGS. 3A-3D illustrate side, front, top, and bottom views of a connector receptacle shell according to an embodiment of the present invention.

FIG. 3B in this specific example illustrates two speed bumps 330 and two fingers 320. When a connector insert is inserted into the connector receptacle, the speed bumps 330 and fingers 320 fit into cutouts or slots on the connector insert.

Figure 3D:
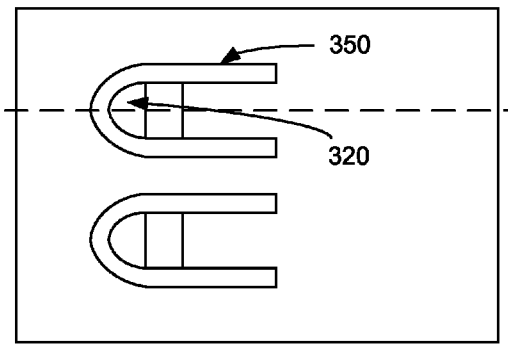
Figure 3A:
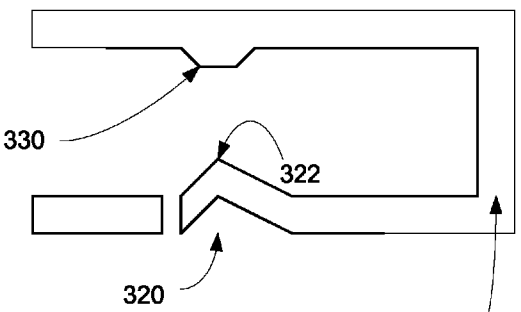
Figure 3C:
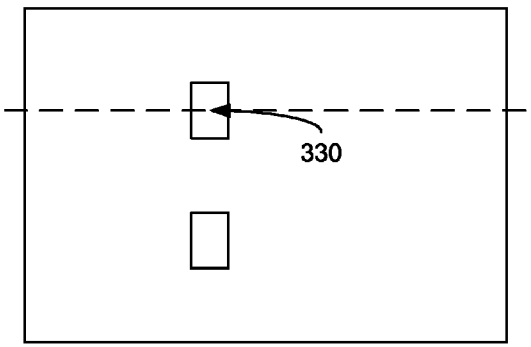

FIG. 3C illustrates the positions of the speed bumps 330. These speed bumps may be rectangular, circular, or have other shapes. The sides of the speed bumps 330 may be sloped, flat, or they may have other shapes.

FIG. 3D illustrates exemplary shapes of the fingers 320. These fingers may be formed by cutting out cutout portions 350 and bending the remaining finger 320 of the connector shell. While in this example, the end of the finger is rounded, other fingers in other embodiments of the present invention may have various shapes. For example, the end may be more squared off, it may be pointed, or it may have other shapes.

It is desirable that when a connector insert is inserted into this connector receptacle, that the connector receptacle provide a tactile response similar to that provided by a conventional connector receptacle. For example, it is desirable that the connector insert have similar initial friction, resistance to insertion, a positive tactile response such as a snap when inserted, hold strength, and resistance to connector insert removal, as compared to a conventional receptacle connector. These forces are adjusted by varying the size and shapes of the features of the connector receptacle. An example is shown in the following figures.

Figure 4A:
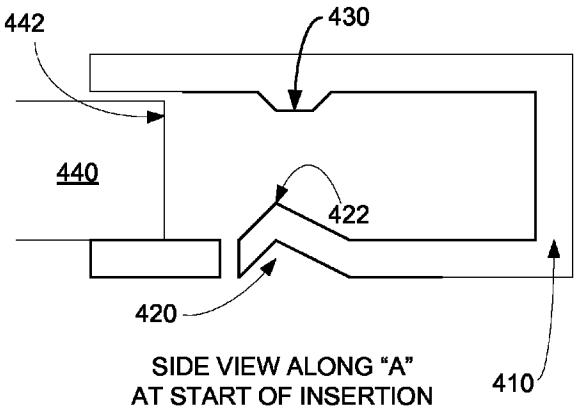
FIGS. 4A-4D illustrate the insertion of a connector insert into a connector receptacle according to an embodiment of the present invention.

FIGS. 4A-4D illustrate the insertion of a connector insert into a connector receptacle according to an embodiment of the present invention. In FIG. 4A, a connector insert 440 is starting to be inserted into a connector receptacle 410. At this time, the primary force acting on the connector insert 440 is friction along the sides of the connector receptacle 410.

Figure 4B:
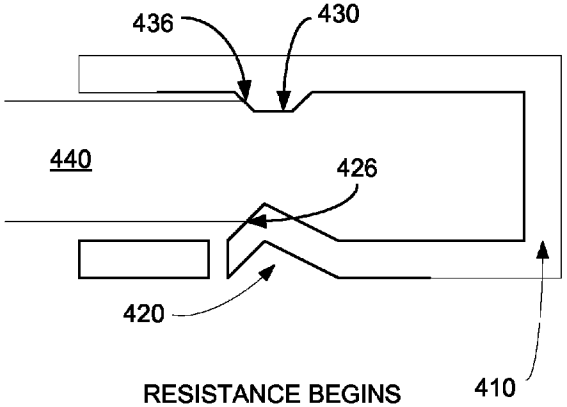

In FIG. 4B, the user begins to feel resistance as she inserts the connector insert 440 into the connector receptacle. This is caused by the leading edge 442 of the connector insert 440 encountering either or both the speed bumps 430 or fingers 420. This resistance can be adjusted by varying the height of the speed bumps 430 and fingers 420. This resistance can also be adjusted by varying the thickness of the fingers 420 (which may be the same as the thickness of the connector receptacle shell) and the slopes of the front edges 436 of the speed bumps 430 and front edges 426 of the fingers 420.

Figure 4C:
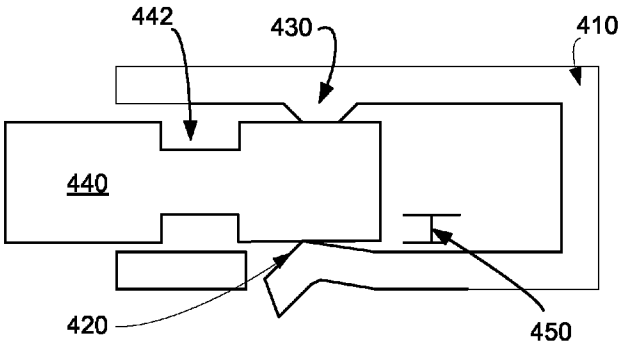

In FIG. 4C, as the user continues to insert the connector insert 440, the connector insert rides up on the speed bumps 430. This in turn pushes the fingers 420 out of the way. Specifically the fingers 420 deflect an amount 450. As the connector insert 440 is completely inserted in the connector receptacle 410, the user feels a snap, which provides a positive tactile response informing the user that the insertion is complete. The degree of snap can be adjusted by varying the height and thickness of the fingers 420.

Figure 4D:
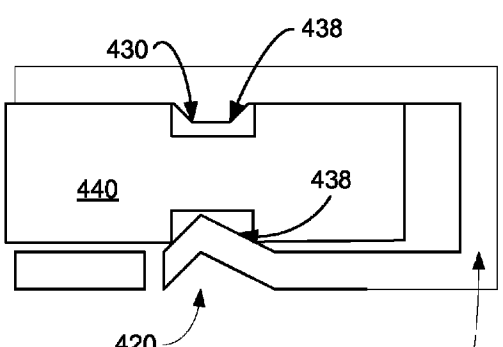

In FIG. 4D, the connector insert 440 is latched in the connector receptacle 410. In this state, the speed bumps 430 are located in a cutout or slot on the connector insert 440. The fingers 420 snap back into cutouts on the bottom of the connector insert 440. These features also provide a hold force that helps prevent the connector insert 440 from being removed from the connector receptacle 410. The hold force can be adjusted by varying the height of the speed bumps 430 and the fingers 420, the thickness of fingers 420, as well as the slopes of the trailing edge 438 of the speed bumps 430 and the trailing edge 428 of the fingers 420.

As the user disengages the connector insert 440 from the connector receptacle 410, these forces must be overcome. Like the hold force, the force necessary to extract the connector insert 440 from the connector receptacle can be adjusted by varying the heights of the speed bumps 430 and fingers 420, the thickness of fingers 420, as well as the slopes of the trailing edges 438 of the speed bumps 430 and the trailing edges 428 of the fingers 420.

In other embodiments of the present invention, speed bumps are not used. Rather a rail, which may be formed as part of a seam along a top of a connector receptacle housing may be used. An example is shown in the following figure.

FIGS. 5A-5D illustrate another connector receptacle according to an embodiment of the present invention. This figure illustrates side, front, top, and bottom views of the connector receptacle. This connector receptacle employs a rail, which may be referred to as a speed rail 530, along the top of the connector receptacle shell, and one or more fingers 520 along the bottom of the connector receptacle shell 510.

Figure 5B:
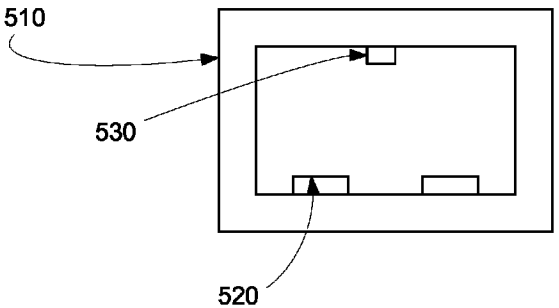
FIGS. 5A-5D illustrate another connector receptacle according to an embodiment of the present invention.
Figure 5D:
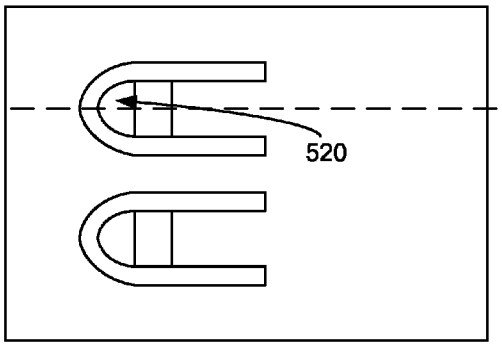
Figure 5A:
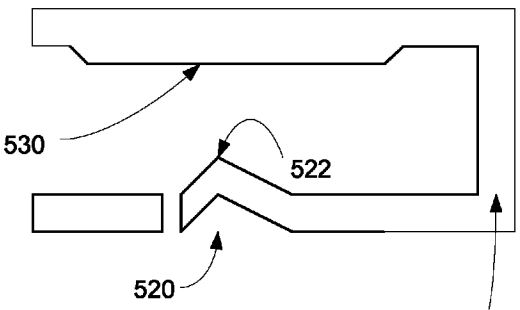
Figure 5C:
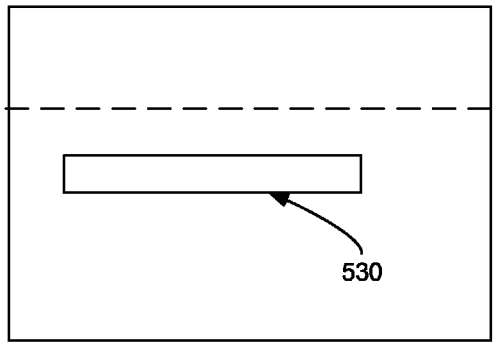

FIG. 5A illustrates the speed rail 530 along the top of the connector receptacle shell 510. In various embodiments of the present invention, the rail may extend along the entire depth of the top of the connector receptacle shell 510. In other embodiments, such as the one shown here, the speed rail 530 extends for a portion of the depth along the top of the connector receptacle shell 510.

FIG. 5B shows the position of the speed rail 530; in this example it is in the center of the top of the connector receptacle shell 510. Again, two fingers 520 are shown on the bottom of the connector receptacle shell 510.

FIG. 5A illustrates the location of the speed rail 530 in this example. In other requirements of the present invention, the speed rail 530 may be placed in other locations. FIG. 5D illustrates two fingers 520 as before. In these various embodiments of the present invention, the fingers 520 may have other shapes. For example, they may be pointed, squared off, or have other shapes.

Again, it is desirable that the forces encountered when a connector insert is inserted into this connector receptacle be similar to that of a conventional connector receptacle. These forces are outlined in the following figure.

Figure 6A:
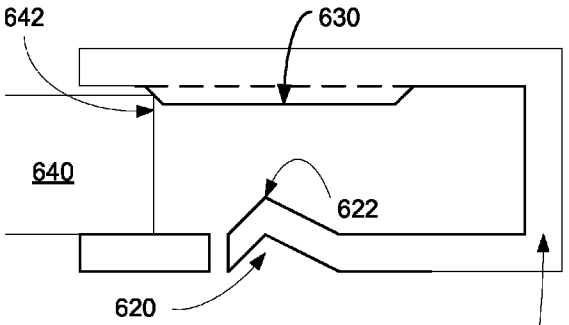
FIGS. 6A-6D illustrate forces encountered by a user inserting a connector insert into in a connector receptacle according to an embodiment of the present invention.

FIGS. 6A-6D illustrate forces encountered by a user inserting a connector insert into in a connector receptacle according to an embodiment of the present invention. In FIG. 6A, resistance begins when the leading edge 642 of connector insert 640 reaches the speed rail 630. This resistance can be adjusted by varying the height and the slope of the front edge of the speed rail 630.

Figure 6B:
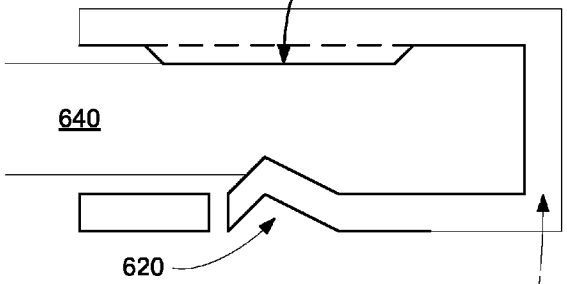

In FIG. 6B, the connector insert 640 rides up on the connector rail 630 and reaches the fingers 620, where resistance increases again. This resistance can be adjusted by varying the height and thickness of the fingers 620, as well as the slope of the front edges of the fingers 620.

Figure 6C:
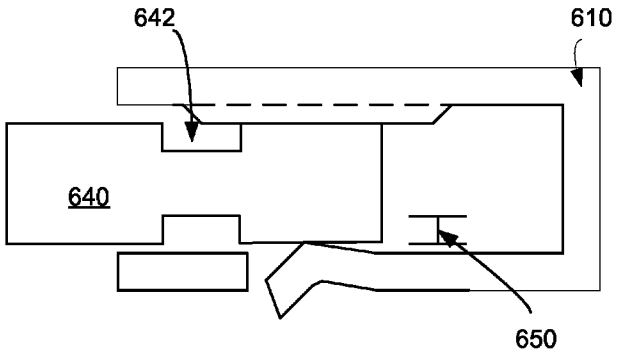

In FIG. 6C, the fingers deflect out of the way as the connector insert 640 continues to be inserted into the connector receptacle 610. As the connector insert 640 is completely inserted in the connector receptacle 610, the user feels a snap, which provides a positive tactile response informing the user that the insertion is complete. The degree of snap can be adjusted by varying the height and thickness of the fingers 620.

Figure 6D:
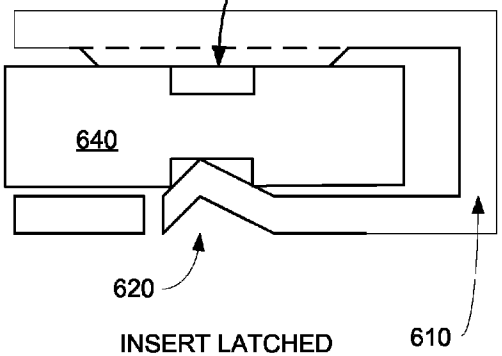

In FIG. 6D, the connector insert 640 is latched in the connector receptacle 610. In this case, the fingers 620 fit into cutouts or slots on the bottom of the connector insert 640. It should be noted that the speed rail 630 does not fit into a top cutout or slot of the connector insert 640. The hold and connector insert removal forces can be adjusted by varying the height and thickness of the fingers 620, as well as the slope of the trailing edges of the fingers 620.

In still another embodiment of the present invention, fingers are not used on the top or bottom of a connector receptacle shell. Rather, speed bumps or speed rails are used on either or both of the top and bottom of the connector receptacle shell. In this case, a portion of the connector receptacle shell may be cut away such that the connector receptacle shell may deform as a connector insert is inserted. In a specific embodiment of the present invention, the right and left sides of the connector receptacle shell are cut away beginning at the opening of the connector receptacle along at least a portion of the depth of the connector receptacle shell. An example is shown in the following figure.

Figure 7B:
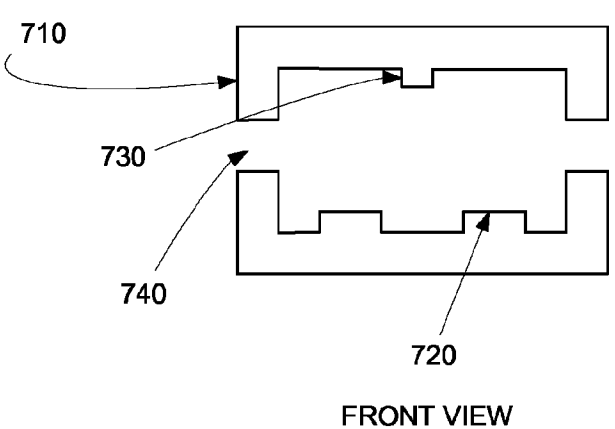
FIGS. 7A-7D illustrate side, font, top, and bottom views of another connector receptacle shell according to an embodiment of the present invention.
Figure 7A:
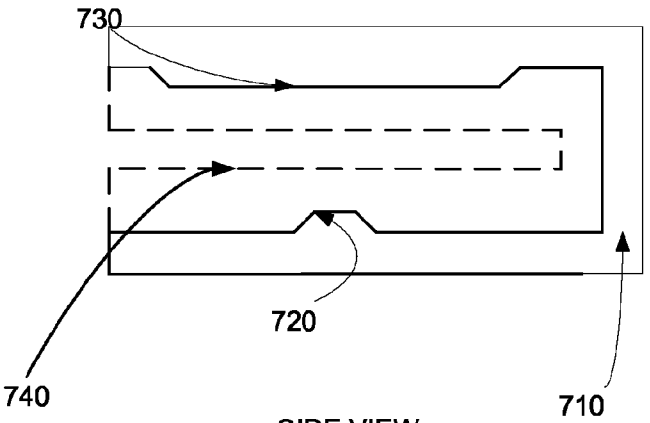

FIGS. 7A-7D illustrate side, font, top, and bottom views of another connector receptacle shell according to an embodiment of the present invention. FIGS. 7A shows a speed rail 730 that is employed along the top of the connector receptacle shell 710, while one or more speed bumps 730 are located on the bottom of the connector receptacle shell 710. The right and left sides are cut away as shown by the outline of the cutout 740. This allows the top and bottoms of the connector receptacle shell to separate when a connector insert is inserted into the connector receptacle.

FIGS. 7B shows that two speed bumps 720 are employed on the bottom, while one speed rail 730 is used on the top of the connector receptacle shell 710. Cutout 740 illustrates locations where the right and left sides of the connector receptacle shell 710 are cut.

Figure 7D:
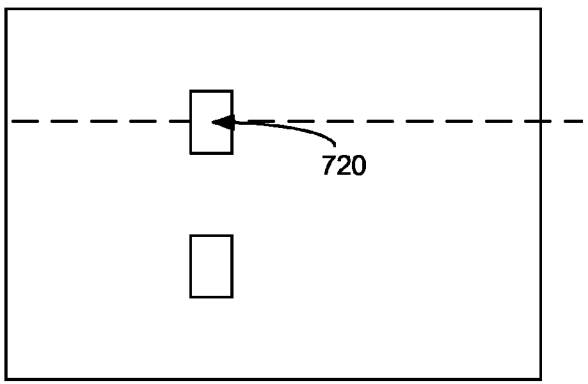
Figure 7C:
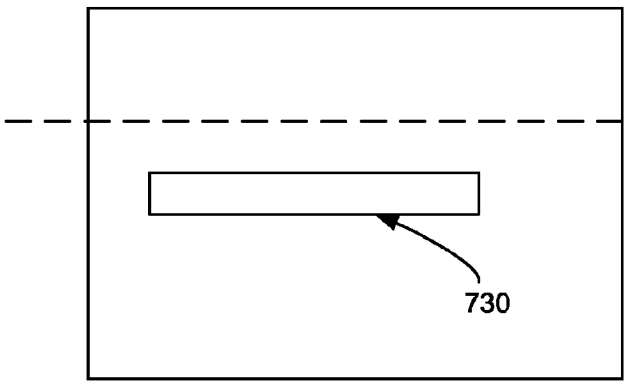

FIG. 7C illustrates the location of the speed rail 730, while FIG. 7D illustrates the positions of one or more speed bumps 720. As before, the speed bumps 720 are located such that they fit in cutouts or slots on a connector insert when the connector insert is fully inserted into the connector receptacle.

Again, it is desirable that this connector receptacle shell provides an insertion experience similar to that of a conventional connector receptacle. Again the forces involved include an insertion force, a tactile feedback such as a snap when insertions is complete, and an amount of hold force that must be overcome when the connector insert is removed from the connector receptacle. These forces are shown in the following figure.

Figure 8A:
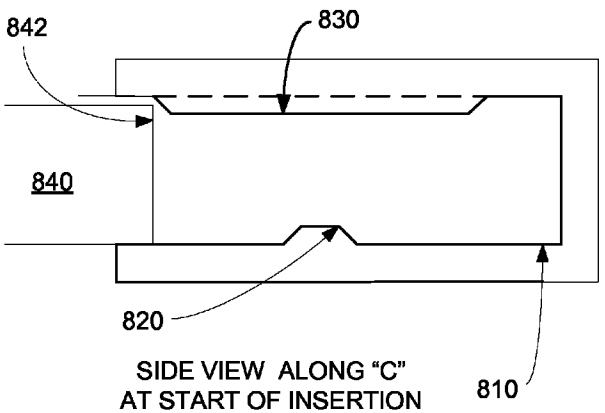
FIGS. 8A-8D illustrate the forces involved when a connector insert is inserted into the connector receptacle of FIGS. 7A-7D.
Figure 8B:
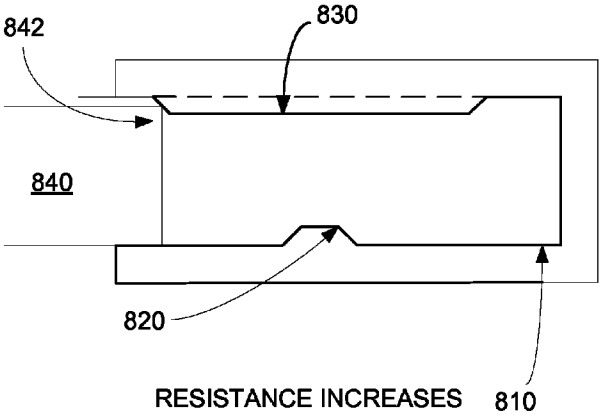

FIGS. 8A-8D illustrate the forces involved when a connector insert is inserted into the connector receptacle of FIGS. 7A-7D. In FIG. 8A, the connector insert 840 faces only frictional forces as it begins to enter the connector receptacle 810. The resistance begins to increase as the connector insert reaches the speed rail 830 in FIG. 8B. This insertion resistance can be adjusted by varying the height of the speed rail 830, as well as the slope of the front edge of the speed rail 830.

Figure 8C:
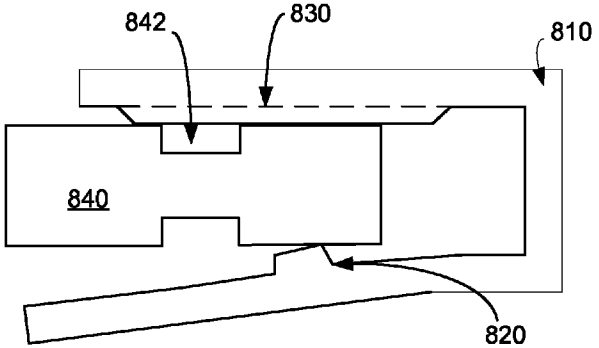

In FIG. 8C, the connector insert 840 reaches the speed bumps 820 and begins to deform in the connector receptacle 810. Specifically, the top and bottom of the connector receptacle 810 begin to move away from each other. That is, the connector receptacle shell 810 opens, thereby allowing the insertion of the connector insert 840. The force at this time can be adjusted by varying the height and slope of the front edge of the speed bumps 820, as well as the width of the side cutouts.

As the connector insert 840 is completely inserted in the connector receptacle 810, the user feels a snap, which provides a positive tactile response informing the user that the insertion is complete. The degree of snap can be adjusted by varying the height of the speed bump 820 as well as the width of the cutouts on the left and right sides of the connector receptacle shell 810.

Figure 8D:
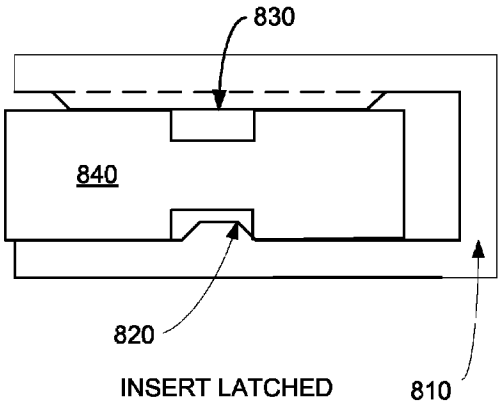

In FIG. 8D, the connector insert 840 is latched in the connector receptacle 810. As before, the speed bump 820 fits in a cutout or slot on the connector insert 840. The hold and extraction forces can be adjusted by varying the width of the cutouts on the left and right sides of the connector receptacle shell 810, as well as the height of the speed bump 820 and slope of the trailing edge of the speed bump 820.

In various embodiments of the present invention, it is desirable to minimize the opening of a connector receptacle. This may be for aesthetic, dust particle, or other reasons. This is possible, particularly with an embodiment of the present invention that employs a speed rail. An example of this is shown in the following figure.

Figure 9B:
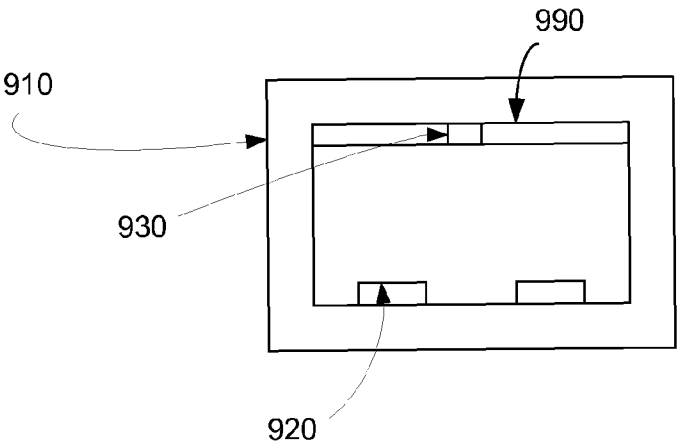
FIGS. 9A-9B illustrate side and front views of a connector receptacle shell according to an embodiment of the present invention.
Figure 9A:
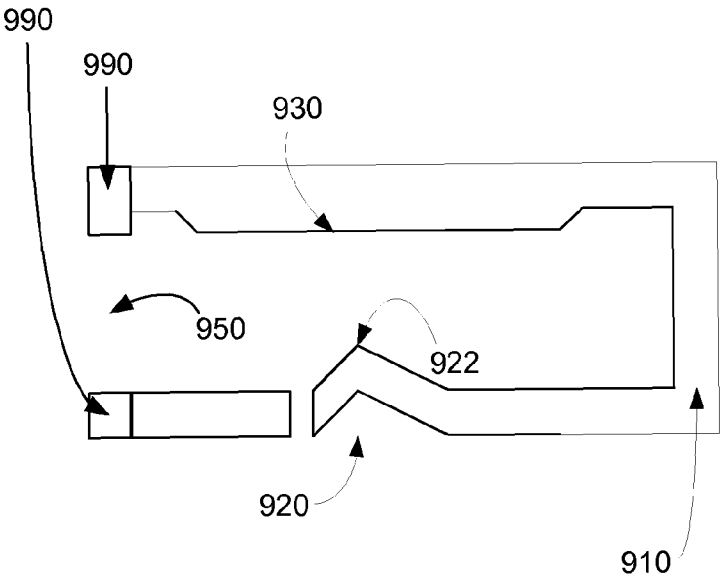

FIGS. 9A-9B illustrate side and front views of a connector receptacle shell according to an embodiment of the present invention. This connector receptacle shell 910 employs a speed bump 930 on its top and one or more fingers 920 on its bottom. A receptacle cover 990 may be used to reduce the size of the opening 950 of the connector receptacle shell 910. Again, this may be for aesthetic reasons, to simply reduce the opening 950 to avoid the introduction of dust or other contaminants, or for other reasons.

The above description of exemplary embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated.

What is claimed is:

1. A connector receptacle comprising:

a housing including:

a top side;

a bottom side;

a right side;

a left side;

a rail on the top side of the connector receptacle, the rail extending a majority of a depth of the connector receptacle; and a first bump on the bottom side and extending from the bottom side towards the top side of the connector receptacle, and a tongue integral with the connector receptacle and disposed between the top and bottom sides of the housing, wherein the housing is split along at least a portion of the right side and a portion of the left side, such that the top side and the bottom side deflect away from each other when a connector insert is inserted into the connector receptacle.

2. The connector receptacle of claim 1 wherein when a connector insert is fully inserted in the connector receptacle, the rail is configured to not fit in a first cutout on the top of the connector insert and the first bump is configured to fit in a second cutout on a bottom of the connector insert.

3. The connector receptacle of claim 2 further comprising:

a second bump on the bottom side of the connector receptacle, wherein when the connector insert is fully inserted in the connector receptacle, the second bump is configured to fit in the second cutout on the bottom of the connector insert.

4. The connector receptacle of claim 1, the tongue including a plurality of contacts.

5. The connector receptacle of claim 4 wherein the tongue and contacts are located such that the contacts form electrical connections with contacts of the connector insert when the connector insert is fully inserted in the connector receptacle.

6. 0The connector receptacle of claim 1 wherein the connector receptacle is compliant with a universal serial bus standard.

7. The connector receptacle of claim 1 wherein the connector receptacle accepts connector inserts that are compliant with a universal serial bus standard.

8. The connector receptacle of claim 1 wherein the housing is formed of plated steel.

9. A connector receptacle for receiving a connector insert, the connector receptacle comprising:

a housing including a first end, a second end, an upper portion having a first surface and a lower portion having a second surface, the upper and lower portion defining a cavity, the first surface facing the second surface, and the second surface facing the first surface, and a slit extending from the first end towards the second end and between the upper portion and the lower portion, a first bump located on the second surface;

a rail located on the first surface, the rail extending the majority of a depth of the cavity of the connector receptacle;

a tongue integral with the connector receptacle and disposed between the top and bottom sides of the housing, wherein the first and second surfaces are substantially parallel in a first position and substantially not parallel in a second position, and wherein an insertion of a connector insert into the connector receptacle changes a dimension of the slit and thereby moves the first and second surfaces from the first position to the second position.

10. The connector receptacle of claim 9 wherein when a connector insert is fully inserted in the connector receptacle, the rail is configured to not fit in a first cutout on the top of the connector insert and the first bump is configured to fit in a second cutout on a bottom of the connector insert.

11. The connector receptacle of claim 10 further comprising:

a second bump on the second surface of the lower portion of the connector receptacle, wherein when the connector insert is fully inserted in the connector receptacle, the second bump is configured to fit in the second cutout on the bottom of the connector insert.

12. The connector receptacle of claim 9, the tongue including a plurality of contacts.

13. The connector receptacle of claim 12 wherein the tongue and contacts are located such that the contacts form electrical connections with contacts of the connector insert when the connector insert is fully inserted in the connector receptacle.

14. A connector receptacle for receiving a connector insert, the connector receptacle comprising:

a housing including a first end, a second end, an upper portion and a lower portion that define a cavity, and a slit extending from the first end towards the second end and between the upper portion and the lower portion, the upper portion comprising a first surface facing the lower portion, and the lower portion comprising a second surface facing the upper portion;

a first bump and a second bump located on the second surface, the first bump having a first length in the direction of the first and second ends;

a rail on the first surface, the rail having a second length in the direction of the first and second ends, wherein the second length is larger than the first length;

a tongue disposed within the cavity, wherein a distance between the first and second surfaces in a first position is less than the distance between the first and second surfaces in a second position, and wherein an insertion of a connector insert into the connector receptacle changes a dimension of the slit and thereby moves the first and second surfaces from the first position to the second position.

15. The connector receptacle of claim 14 wherein the rail extends a majority of a depth of the cavity of the connector receptacle.

16. The connector receptacle of claim 15 wherein when a connector insert is fully inserted in the connector receptacle, the rail is configured to not fit in a first cutout on the top of the connector insert and the first bump is configured to fit in a second cutout on a bottom of the connector insert.

17. The connector receptacle of claim 16 further comprising:

a second bump on the second surface of the lower portion of the connector receptacle, wherein when the connector insert is fully inserted in the connector receptacle, the second bump is configured to fit in the second cutout on the bottom of the connector insert.

18. The connector receptacle of claim 14 further comprising:

a plurality of contacts disposed on the tongue.

19. The connector receptacle of claim 14 wherein the connector receptacle is compliant with a universal serial bus standard.

* * * * *

UNITED STATES PATENT AND TRADEMARK OFFICE

CERTIFICATE OF CORRECTION

PATENT NO. : 8,591,246 B2
APPLICATION NO. : 13/276327
DATED : November 26, 2013
INVENTOR(S) : Brett William Degner et al.

It is certified that error appears in the above-identified patent and that said Letters Patent is hereby corrected as shown below:

In the claims please make the correction as shown below:

Column 8, Line 1, Claim 6: please delete "0".

Signed and Sealed this
Twenty-second Day of April, 2014

Michelle K. Lee

Michelle K. Lee
*Deputy Director of the United States Patent and Trademark Office*